US012247748B2

(12) United States Patent
Konowalczyk

(10) Patent No.: US 12,247,748 B2
(45) Date of Patent: Mar. 11, 2025

(54) HEATING INSTALLATIONS, METHODS AND SYSTEMS

(71) Applicant: OCTOPUS ENERGY HEATING LIMITED, London (GB)

(72) Inventor: Peter Konowalczyk, London (GB)

(73) Assignee: Octopus Energy Heating Limited, London (GB)

( * ) Notice: Subject to any disclaimer, the term of this patent is extended or adjusted under 35 U.S.C. 154(b) by 0 days.

(21) Appl. No.: 18/264,270

(22) PCT Filed: Feb. 7, 2022

(86) PCT No.: PCT/IB2022/051081
§ 371 (c)(1),
(2) Date: Aug. 4, 2023

(87) PCT Pub. No.: WO2022/168049
PCT Pub. Date: Aug. 11, 2022

(65) Prior Publication Data

US 2024/0302056 A1 Sep. 12, 2024

(30) Foreign Application Priority Data

Feb. 7, 2021 (GB) ..... 2101678
Jul. 2, 2021 (GB) ..... 2109593
(Continued)

(51) Int. Cl.
*F24D 11/02* (2006.01)
*F24F 11/64* (2018.01)
(Continued)

(52) U.S. Cl.
CPC ..... *F24D 11/02* (2013.01); *F24D 11/0214* (2013.01); *F24F 11/64* (2018.01);
(Continued)

(58) Field of Classification Search
CPC ..... F24F 11/46; F24F 11/30; F24F 2110/10; F24F 11/63; F24F 11/64; F24F 2130/10;
(Continued)

(56) References Cited

U.S. PATENT DOCUMENTS 4,798,059 A 1/1989 Morita
11,733,427 B1 * 8/2023 Thielke ..... G06N 3/0464 702/3
(Continued)

FOREIGN PATENT DOCUMENTS

AT 504285 A1 4/2011
CN 201191144 Y 2/2009
(Continued)

OTHER PUBLICATIONS

Testi et al. "Model predictive control of a hybrid heat pump system and impact of the prediction horizon on cost-saving potential and optimal storage capacity" (Year: 2019).*
(Continued)

*Primary Examiner* — Darrin D Dunn
(74) *Attorney, Agent, or Firm* — Husch Blackwell LLP

(57) ABSTRACT

A heating installation for premises includes a controller coupled to an air source heat pump; a premises heating arrangement; and a local weather sensing arrangement. The controller is configured to receive weather forecast data from an external source, and local weather status information from the local weather sensing arrangement. The controller is also configured to set a control algorithm based on both the weather forecast data and the local weather status information, and control a supply of energy from the air source heat pump to the heating arrangement based on the set control algorithm; and increasing energy input into the heating arrangement in anticipation of a forecast fall in the temperature of the air from which the air source heat pump
(Continued)

extracts energy. A method of controlling a premises heating installation is also disclosed.

12 Claims, 6 Drawing Sheets

(30) Foreign Application Priority Data

| | | |
|---|---|---|
| Jul. 2, 2021 | (GB) | 2109594 |
| Jul. 2, 2021 | (GB) | 2109596 |
| Jul. 2, 2021 | (GB) | 2109597 |
| Jul. 2, 2021 | (GB) | 2109598 |
| Jul. 2, 2021 | (GB) | 2109599 |
| Jul. 2, 2021 | (GB) | 2109600 |
| Aug. 2, 2021 | (GB) | 2111076 |

(51) Int. Cl.
*F24F 11/65* (2018.01)
*F24F 120/14* (2018.01)
*F24F 130/10* (2018.01)

(52) U.S. Cl.
CPC ..... *F24F 11/65* (2018.01); *F24F 2120/14* (2018.01); *F24F 2130/10* (2018.01)

(58) Field of Classification Search
CPC ..... G05B 15/02; G05B 2219/2642; G05B 19/042; G05B 2219/2614; G05B 13/026; G05B 13/02; G05B 2219/2658; G05B 11/01; G05B 13/021; F24D 2200/12; F24D 2220/042; F24D 17/02; F24D 19/1054; F24D 11/003
See application file for complete search history.

(56) References Cited

U.S. PATENT DOCUMENTS

| | | | | |
|---|---|---|---|---|
| 2011/0271953 | A1 | 11/2011 | Wortmann et al. | |
| 2013/0327313 | A1* | 12/2013 | Arnold | F24H 15/37 126/344 |
| 2015/0134124 | A1* | 5/2015 | Carter | G06N 5/04 700/278 |
| 2018/0038616 | A1 | 2/2018 | Scheers et al. | |
| 2021/0318027 | A1 | 10/2021 | Boros | |

FOREIGN PATENT DOCUMENTS

| | | | |
|---|---|---|---|
| CN | 201265954 | Y | 7/2009 |
| CN | 103154619 | A | 6/2013 |
| CN | 103162346 | A | 6/2013 |
| CN | 203758014 | U | 8/2014 |
| CN | 110925856 | A | 3/2020 |
| CN | 110925943 | A | 3/2020 |
| CN | 210345882 | U | 4/2020 |
| CN | 111189348 | A | 5/2020 |
| CN | 111750528 | A | 10/2020 |
| CN | 111811142 | A | 10/2020 |
| CN | 211739265 | U | 10/2020 |
| DE | 29921889 | U | 6/2000 |
| DE | 10006564 | A1 | 8/2000 |
| DE | 102008043030 | A1 | 4/2010 |
| DE | 102014225693 | | 6/2016 |
| DE | 10151253 | C1 | 11/2022 |
| EP | 0007538 | A1 | 2/1980 |
| EP | 1684035 | A2 | 7/2006 |
| EP | 2484987 | A1 | 8/2012 |
| EP | 3196558 | A1 | 7/2017 |
| GB | 2509354 | A | 7/2014 |
| JP | S5795534 | A | 6/1982 |
| JP | S5812992 | A | 1/1983 |
| JP | H01256792 | A | 10/1989 |
| JP | H1144495 | A | 2/1999 |
| JP | 2002-098407 | A | 4/2002 |
| JP | 2012002469 | A | 1/2012 |
| JP | 2014-020764 | A | 2/2014 |
| JP | 6 525 370 | B1 | 6/2019 |
| KR | 20100030141 | A | 3/2010 |
| WO | 2020209979 | A2 | 10/2020 |

OTHER PUBLICATIONS

Combined Search and Examination Report dated Sep. 14, 2021 for United Kingdom Pat. Appl. No. GB2111076.2.
Examination Report dated Oct. 10, 2022 for United Kingdom Pat. Appl. No. GB2111076.2.
Search Report dated Aug. 20, 2021 for United Kingdom Pat. Appl. No. GB2109593.0.
Search Report dated Aug. 12, 2021 for United Kingdom Pat. Appl. No. GB2109594.8.
Search Report dated Aug. 10, 2021 for United Kingdom Pat. Appl. No. GB2109596.3.
Search Report dated Aug. 10, 2021 for United Kingdom Pat. Appl. No. GB2109597.1.
Search Report dated Aug. 10, 2021 for United Kingdom Pat. Appl. No. GB2109598.9.
Examination Report dated Feb. 14, 2023 for United Kingdom Pat. Appl. No. GB2109599.7.
Search Report dated Aug. 10, 2021 for United Kingdom Pat. Appl. No. GB2109599.7.
Search Report dated Aug. 20, 2021 for United Kingdom Pat. Appl. No. GB2109600.3.
Search Report dated Jan. 16, 2023 for United Kingdom Pat. Appl. No. GB2215387.8.
Search Report dated Feb. 20, 2023 for United Kingdom Pat. Appl. No. GB2300970.7.
Search Report dated Apr. 25, 2023 for United Kingdom Pat. Appl. No. GB2304349.0.
Machine Translation of CN211739265.
Machine Translation of CN110925943.
Machine Translation of CN110925856.
Machine Translation of DE10006564.
Machine Translation of CN111811142.
Machine Translation of CN201265954.
Machine Translation of CN203758014.
Machine Translation of CN111750528.
Machine Translation of JP2012002469.
Machine Translation of DE102008043030.
Machine Translation of EP0007538.
Machine Translation of JPS5812992.
Machine Translation of CN111189348.
Machine Translation of JPH01256792.
Machine Translation of CN201191144.
Machine Translation of EP1684035.
Machine Translation of JPS5795534.
Machine Translation of JPH1144495.
Machine Translation of KR20100030141.
Machine Translation of DE10151253.
Machine Translation of DE29921889.
Machine Translation of DE102014225693.
Machine Translation of AT504285.
International Search Report and Written Opinion dated May 30, 2022 for PCT/IB2022/051081.

* cited by examiner

HEATING INSTALLATIONS, METHODS AND SYSTEMS

CROSS REFERENCES

This application is a U.S. National Phase Application of International Application No. PCT/IB2022/051081 filed on Feb. 7, 2022, which in turn claims priority to UK Application Nos.

2101678.7 filed on Feb. 7, 2021:
2109593.0 filed on Jul. 2, 2021:
2109594.8 filed on Jul. 2, 2021:
2109596.3 filed on Jul. 2, 2021;
2109597.1 filed on Jul. 2, 2021:
2109598.9 filed on Jul. 2, 2021:
2109599.7 filed on Jul. 2, 2021:
2109600.3 filed on Jul. 2, 2021; and
2111076.2 filed on Aug. 2, 2021 the disclosures of which are incorporated herein by reference in their entireties.

TECHNICAL FIELD

The present disclosure variously relates to heating installation for premises, and related methods, systems and apparatus.

BACKGROUND

According to Directive 2012/27/EU buildings represent 40% of the final energy consumption and 36% of the $CO_2$ emissions of the European Union. The EU Commission report of 2016 "Mapping and analyses of the current and future (2020-2030) heating/cooling fuel deployment (fossil/renewables)" concluded that in EU households, heating and hot water alone account for 79% of total final energy use (192.5 Mtoe). The EU Commission also report that, "according to 2019 figures from Eurostat, approximately 75% of heating and cooling is still generated from fossil fuels while only 22% is generated from renewable energy. To fulfil the EU's climate and energy goals, the heating and cooling sector must sharply reduce its energy consumption and cut its use of fossil fuels. Heat pumps (with energy drawn from the air, the ground or water) have been identified as potentially significant contributors in addressing this problem.

In many countries, there are policies and pressures to reduce carbon footprint. For example, in the UK in 2020 the UK Government published a whitepaper on a Future Homes Standard, with proposals to reduce carbon emissions from new homes by 75 to 80% compared to existing levels by 2025. In addition, it was announced in early 2019 that there would be a ban on the fitment of gas boilers to new homes from 2025. It is reported that in the UK at the time of filing 78% of the total energy used for the heating of buildings comes from gas, while 12% comes from electricity.

The UK has a large number of small, 2-3 bedroom or less, properties with gas-fired central heating, and most of these properties use what are known as combination boilers, in which the boiler acts as an instantaneous hot water heater, and as a boiler for central heating. Combination boilers are popular because they combine a small form factor, provide a more or less immediate source of "unlimited" hot water (with 20 to 35 kW output), and do not require hot water storage. Such boilers can be purchased from reputable manufactures relatively inexpensively. The small form factor and the ability to do without a hot water storage tank mean that it is generally possible to accommodate such a boiler even in a small flat or house-often wall-mounted in the kitchen, and to install a new boiler with one man day's work. It is therefore possible to get a new combi gas boiler installed inexpensively. With the imminent ban on new gas boilers, alternative heat sources will need to be provided in place of gas combi boilers. In addition, previously fitted combi boilers will eventually need to be replaced with some alternative.

Although heat pumps have been proposed as a potential solution to the need to reduce reliance on fossil fuels and cut $CO_2$ emissions, they are currently unsuited to the problem of replacing gas fired boilers in smaller domestic (and small commercial) premises or a number of technical, commercial and practical reasons. They are typically very large and need a substantial unit on the outside of the property. Thus, they cannot easily be retrofitted into a property with a typical combi boiler. A unit capable of providing equivalent output to a typical gas boiler would currently be expensive and may require significant electrical demand. Not only do the units themselves cost multiples of the equivalent gas fired equivalent, but also their size and complexity mean that installation is technically complex and therefore expensive. A storage tank for hot water is also required, and this is a further factor militating against the use of heat pumps in small domestic dwellings. A further technical problem is that heat pumps tend to require a significant time to start producing heat in response to demand, perhaps 30 seconds for self-checking then some time to heat up-so a delay of 1 minute or more between asking for hot water and its delivery. For this reason, attempted renewable solutions using heat pumps and/or solar are typically applicable to large properties with room for a hot water storage tank (with space demands, heat loss and *legionella* risk).

There therefore exists a need to provide a solution to the problem of finding a suitable technology to replace gas combi boilers, particularly for smaller domestic dwellings.

More generally, there is a continuing need to improve the effective efficiency of heat pumps, and in particular of air source heat pumps which are the most cheaply installed heat pump type.

SUMMARY

According to a first aspect, there is provided a heating installation for premises, the installation comprising: a controller, and coupled to the controller: an air source heat pump; a premises heating arrangement; and a local weather sensing arrangement; wherein the controller is configured to: receive weather forecast data from an external source, and local weather status information from the local weather sensing arrangement; set a control algorithm based on both the weather forecast data and the local weather status information; and control a supply of energy from the air source heat pump to the heating arrangement based on the set control algorithm; wherein the controller is configured to increase energy input into the heating arrangement in anticipation of a forecast fall in the temperature of the air from which the air source heat pump extracts energy.

Preferably, the controller is configured to increase energy input into the heating arrangement in anticipation of a forecast fall in the temperature of the air from which the air source heat pump extracts energy.

Preferably, the controller is configured to control the supply of energy based on a predicted likelihood that the premises heating arrangement will be activated or used or required during a forecast period of lowered temperature. Optionally, the controller is configured to predict the likelihood based on past household behaviour of the premises, and/or on past behaviour of comparable households. Optionally, the controller may be configured to take account of occupancy or predicted occupancy of the premises in predicting the likelihood.

Optionally, the controller is configured to take account of scheduled activity of occupants of the premises in predicting the likelihood.

Optionally, the controller is configured to override a setting of the heating arrangement.

Optionally, the heating installation further comprises an energy store arranged to receive energy from the heat pump, the controller being configured to control a supply of energy from the air source heat pump to the energy store based on the set control algorithm. Preferably, the energy store comprises a mass of phase change material that is used to store energy as latent heat. Optionally, the controller is configured to control a supply of energy to the energy store to increase the amount of energy stored in the store as sensible heat. Preferably, the energy store is arranged to supply energy to a hot water system of the premises.

According to a second aspect, there is provided a method of controlling a premises heating installation, the heating installation including an air source heat pump, the method comprising: receiving weather forecast data from an external source, and local weather status information from a local weather sensing arrangement; setting a control algorithm based on both the weather forecast data and the local weather status information; controlling the air source heat pump based on the setting of the control algorithm; and increasing energy input into the heating arrangement in anticipation of a forecast fall in the temperature of the air from which the air source heat pump extracts energy.

Preferably, the method further comprises controlling the supply of energy based on a predicted likelihood that the premises heating arrangement will be any one of activated, used, or required during a forecast period of lowered temperature.

Optionally, the method further comprises predicting the likelihood based on past household behaviour of the premises, and/or on past behaviour of comparable households.

Optionally, the method further comprises taking account of occupancy or predicted occupancy of the premises in predicting the likelihood.

Optionally, the method further comprises taking account of scheduled activity of occupants of the premises in predicting the likelihood.

Optionally, the method further comprises overriding a setting of the heating arrangement.

In the method according to the second aspect, the installation may include an energy store arranged to receive energy from the heat pump, the method further comprising controlling a supply of energy from the air source heat pump to the energy store based on the set control algorithm.

Preferably, the energy store comprises a mass of phase change material that is used to store energy as latent heat, the method further comprising controlling a supply of energy to the energy store to increase the amount of energy stored in the store as sensible heat.

According to a third aspect there is provided a domestic green power generation installation comprising: a controller, and coupled to the controller: a green energy source; an energy sink; and a local weather sensing arrangement; wherein the controller is configured to: receive weather forecast data from an external source, and local weather status information from the local weather sensing arrangement; set a control algorithm based on both the weather forecast data and the local weather status information; and control a supply of energy from the green energy source to the energy sink and/or the energy store based on the set control algorithm. Preferably also to increase energy input into the heating arrangement in anticipation of a forecast fall in the temperature of the air from which the air source heat pump extracts energy.

Preferably, the green energy source is selected from the group comprising: an air source heat pump, a photovoltaic installation including one or more photovoltaic cells, and a wind turbine.

Preferably, the energy sink is selected from the group comprising: a heating installation for premises, an energy store, and a hot water supply system.

According to a fourth aspect there is provided a method of controlling a domestic heating installation that includes a green energy source, the method comprising: receiving weather forecast data from an external source, and local weather status information from a local weather sensing arrangement; setting a control algorithm based on both the weather forecast data and the local weather status information; and controlling a supply of energy from the green energy source to the domestic heating installation based on the setting of the control algorithm. Preferably also increasing energy input into the heating arrangement in anticipation of a forecast fall in the temperature of the air from which the air source heat pump extracts energy.

These aspects are merely an illustrative aspect of the innumerable aspects associated with the present disclosure and should not be deemed as limiting in any manner. These and other aspects, features and advantages of the present disclosure will become apparent from the following detailed description when taken in conjunction with the referenced figures.

BRIEF DESCRIPTION OF THE DRAWINGS

Further features and advantages of the present disclosure will become more apparent from the description of a preferred but non-exclusive embodiment of a method and a apparatus for managing containers according to the present disclosure, illustrated by way of non-limiting example in the accompanying drawings, in which.

DETAILED DESCRIPTION

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. The following definitions and non-limiting guidelines must be considered in reviewing the description of the technology set forth herein.

In the following detailed description numerous specific details are set forth in order to provide a thorough understanding of the present disclosure. However, it will be understood by those skilled in the art that the present disclosure may be practiced without these specific details. For example, the present disclosure is not limited in scope to the particular type of industry application depicted in the figures. In other instances, well-known methods, procedures, and components have not been described in detail so as not to obscure the present disclosure.

The headings and sub-headings used herein are intended only for general organization of topics within the present disclosure and are not intended to limit the disclosure of the technology or any aspect thereof. In particular, subject matter disclosed in the "Background" may include novel technology and may not constitute a recitation of prior art. Subject matter disclosed in the "Summary" is not an exhaustive or complete disclosure of the entire scope of the technology or any embodiments thereof. Classification or discussion of a material within a section of this specification as having a particular utility is made for convenience, and no inference should be drawn that the material must necessarily or solely function in accordance with its classification herein when it is used in any given composition.

The citation of references herein does not constitute an admission that those references are prior art or have any relevance to the patentability of the technology disclosed herein. All references cited in the "Detailed Description" section of this specification are hereby incorporated by reference in their entirety.

Figure 1:
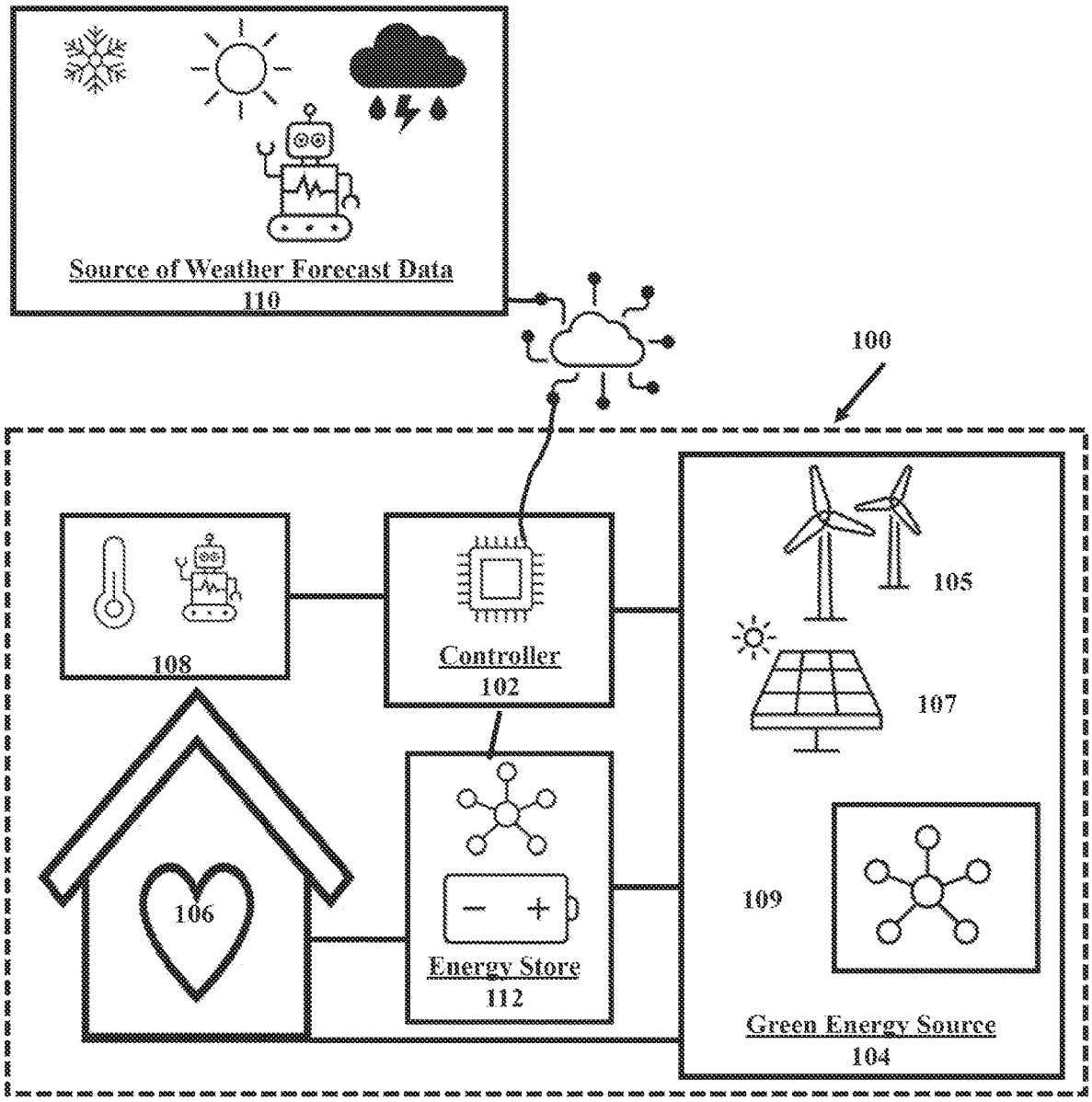
FIG. 1 shows schematically an overview of a system according to an aspect of the present disclosure.

FIG. 1 shows schematically an overview of the system 100 according to an aspect of the present disclosure. The system includes a controller 102 coupled to a green energy source 104, an energy sink 106, and a local weather sensing arrangement 108. The controller 102 is configured to receive weather forecast data from an external source 110, for example via a wired or wireless connection, and local weather status information from the local weather sensing arrangement 108. The system also optionally includes an energy store 112 which is coupled to the green energy source 104, the controller 102, and the energy sink 106. The green energy source 104 may, for example include a wind turbine 105, a photovoltaic arrangement 107 or, more preferably an air source heat pump 109. The controller 102 is further configured to set a control algorithm based on both the weather forecast data and the local weather status information, and to control a supply of energy from the green energy source to the energy sink and/or the energy store based on the set control algorithm.

Figure 2:
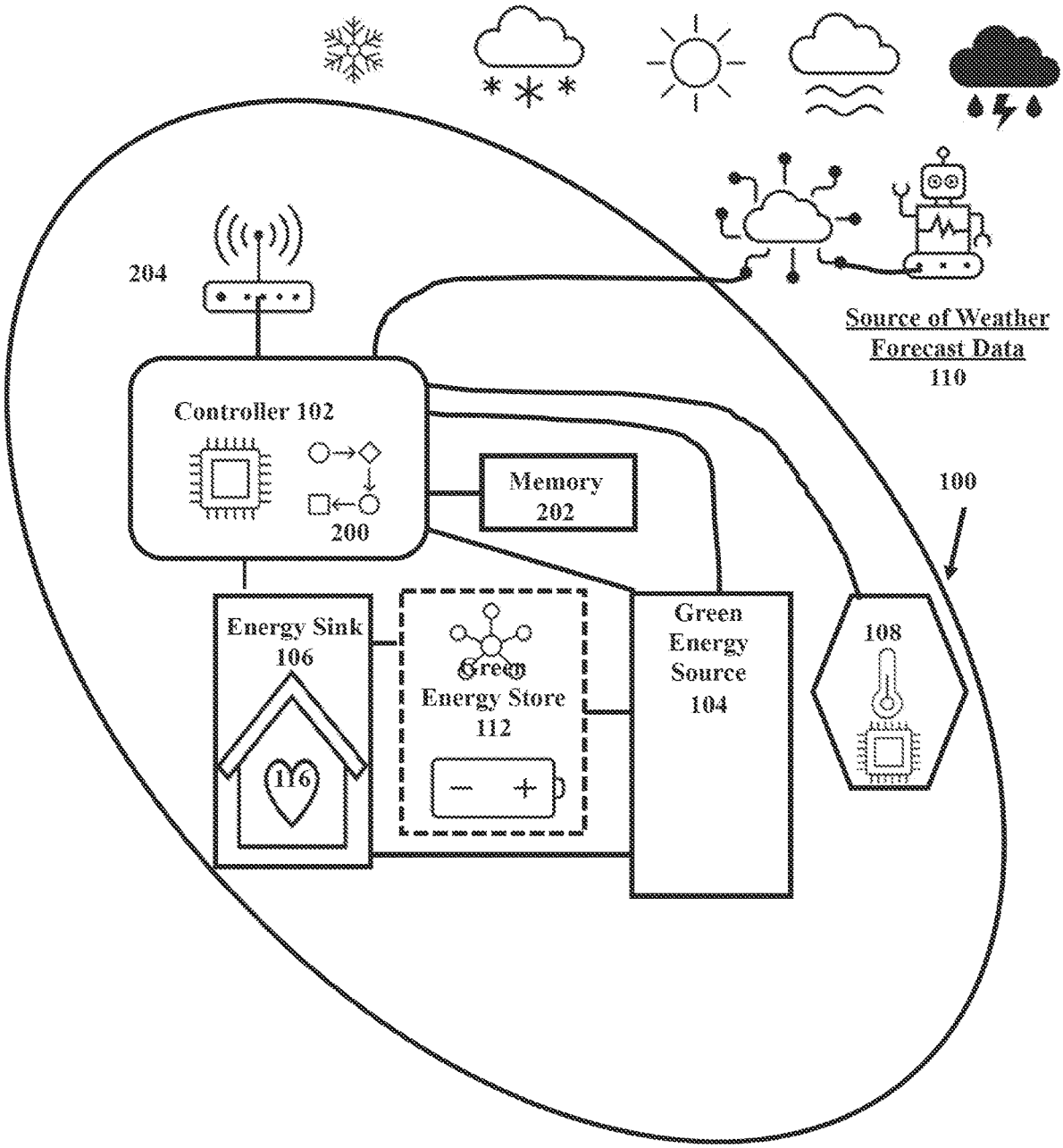
FIG. 2 corresponds generally to FIG. 1, but includes more detail.

FIG. 2 corresponds generally to FIG. 1 but includes rather more detail. The controller 102 operates a control algorithm based on received weather forecast data, adjusted if necessary based on local weather status information from a local weather sensing arrangement 108. The control algorithm 103 is operated with a view to using energy that is available currently, or that is predicted to become available, prior to a local change in the weather which is forecast to reduce the amount of energy available from the green energy source 104. For example, if the green energy source is an air source heat pump, and the local air temperature is predicted to drop, and/or the relative humidity is predicted to drop, the control algorithm may be used to extract energy, and supply this to the energy sink, for example a premises heating installation, and/or an energy store, for example a thermal energy store, in anticipation that this extracted energy will be useful later. Similarly, if the green energy source comprises one or more photovoltaic cells or arrays, and a currently clear, or substantially clear, sky is forecast to be replaced by heavy cloud cover, the control algorithm may be used to divert energy from the photovoltaics to supply the energy sink, for example a premises heating installation, and/or an energy store such as a battery or super capacitor arrangement, rather than supplying all or most of the captured energy to an electricity grid. In the case that the green energy source comprises one or more wind turbines, and a currently, or shortly to be, windy day is forecast to be replaced by a prolonged period without wind, the captured energy can be treated as just described with reference to the photovoltaic arrangement. With any of these alternatives, the controller algorithm may be arranged to increase energy input into a premises heating arrangement, an energy sink, in anticipation of a forecast fall in air temperature. A forecast for in air temperature may make it more likely that occupants of the premises will start to use the heating installation, and/or increase its temperature setting, to offset the effect of the forecast fall in air temperature.

Thus, the controller may be configured to control the supply of energy based on a predicted likelihood that the premises heating arrangement will be activated/used/required during a forecast period of lowered temperature. The controller may be configured to predict the likelihood based on past household behaviour of the premises, and/or on past behaviour of comparable households. The controller may be configured to use a machine-learning algorithm to learn occupant behaviour from the settings and operation of, inter alia, a premises heating arrangement. The controller may also be provided with data on the behaviour of comparable households, either provided on installation/initial configuration of the system or provided or updated from a supplier or operator server in the cloud, for example.

The controller is also preferably configured to take account of occupancy, or predicted occupants of the premises, in predicting the likelihood. To do this, the controller may be configured to take account of schedule activity of occupants of the premises in predicting the likelihood—the controller having, optionally, access to schedules, calendars, and/or appointment details of occupants of the premises respect, the controller may operate in "smart home" mode. The controller may also be supplied with information from presence detectors, for example movement sensors (e.g., PIR sensors) and or door sensors which may be provided as part of a security monitoring system, as well as, or instead of, being supplied with information from the electrical system of the premises strike that which may provide information on the activation of, for example, lighting circuits and the like in the premises.

The use of a local weather sensing arrangement 108 enables more accurate prediction and detection of weather events affecting the premises, increasing the ability to achieve energy savings in the running of the system. The controller 102 may be configured to run a machine learning algorithm which is configured to learn how the weather experienced by the premises, as detected by the local weather sensing arrangement, differs from the weather forecast data received, for example in terms of time delay and, optionally, severity. Using such a machine learning algorithm, the controller 102 may be able to make better predictions of when it may be beneficial to increase a supply of energy from the green energy source to a local energy sink and/or energy store.

The local weather sensing arrangement 108 is preferably arranged to sense air temperature, the humidity of the air, and barometric pressure. The arrangement 108 may include separate sensors to detect each of these variables, but preferably the arrangement 108 is based upon an integrated weather sensing device, for example a weather sensing chip. Such a chip is available as the Bosch Sensortec BME280 integrated environmental unit which provides a humidity sensor measuring relative humidity, barometric pressure and ambient temperature, all to a high degree of accuracy: the humidity sensor is accurate to ±3% relative humidity, the pressure sensor is accurate to ±0.25%, and the temperature sensor is accurate to ±1° C. over the range 0-65° C. The BME280 has a weather monitoring mode which provides pressure temperature and humidity readings once a minute, which is frequent enough for our purposes. Additionally, the local weather sensing arrangement 108 may include a wind speed sensor and wind direction detector, since wind direction and speed can be very useful indicators of current and likely imminent weather conditions-such as indicating the possible arrival, passage, and passing of cold weather fronts, etc.

Figure 3:
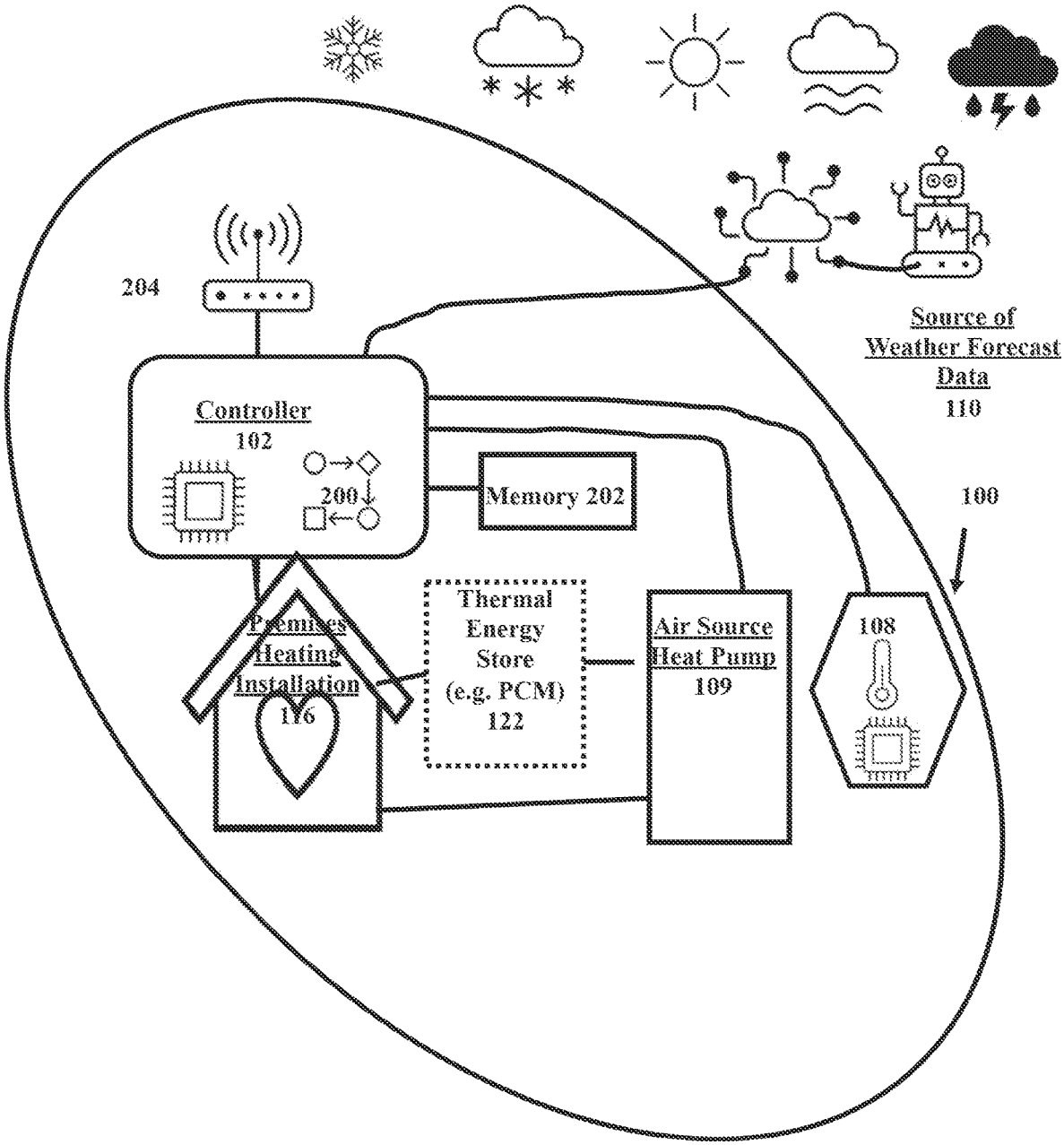
FIG. 3 shows schematically details of a system according to an aspect of the present disclosure.

FIG. 3 shows schematically details of a system according to an aspect of the present disclosure, which corresponds very closely to FIG. 2, but in which the green energy source is an air source heat pump 109 and the energy sink includes a premises heating installation 116, and preferably a thermal energy store, ideally including a phase change material that whose phase change is used to store energy as latent heat.

Figure 4:
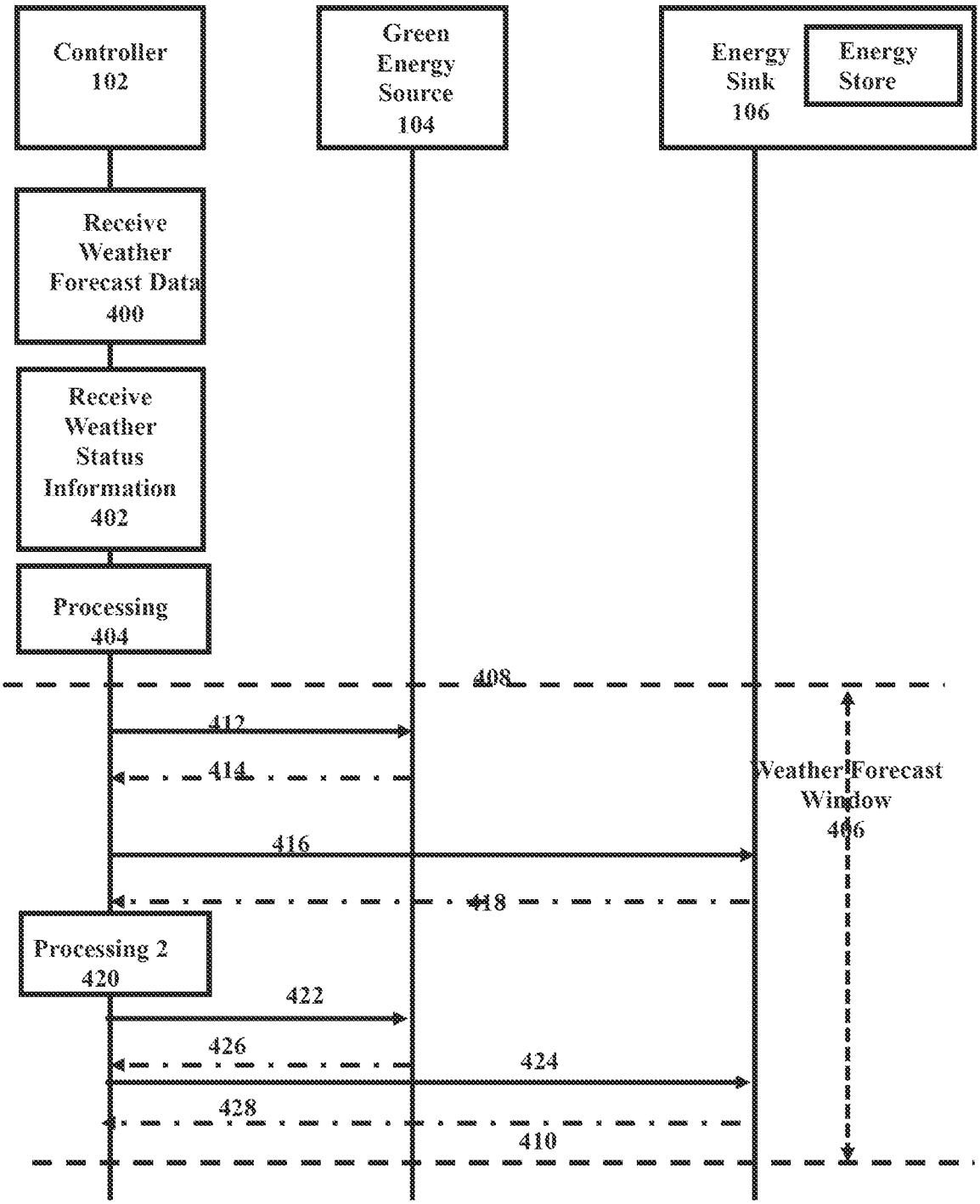
FIG. 4 is a schematic timeline diagram illustrating the operation of a controller according to an aspect of the present disclosure.

FIG. 4 is a schematic timeline diagram illustrating the operation of the controller 102 according to an aspect of the present disclosure.

At 400, the controller receives weather forecast data from an external source. The controller may be configured to collect such data periodically, or the data may be pushed to the controller periodically or, more preferably, whenever a significant change in weather is forecast. These weather forecast data may be provided, for example, by a national or regional meteorological function, such as the Met Office in the UK, a national or regional broadcaster, such as the BBC in the UK, or any other national, regional or local provider of weather forecast information, all of whom provide data feeds over the Internet. Also of course, these weather forecast data may be provided by a data aggregator, news agency, or any other intermediary or source.

At 402, the controller receives local weather status information from a local weather sensing arrangement, for example based on a device such as the BME280. The controller may be configured to collect such weather status information periodically, or the information may be pushed or otherwise supplied to the controller periodically or, more preferably whenever one or more signs of an imminent significant change in weather is detected. Although the Figure shows the controller receiving the weather forecast data before receiving the local weather status information, the order may be reversed with the controller receiving the local weather status information before receiving the weather forecast data. For example, the controller may be arranged to receive and process local weather status information continuously (for example once a minute, or once every few minutes), detecting indicators of significant forthcoming or instantaneous changes in local weather. The local weather sensing arrangement 108 may, and preferably does, include a processing capability arranged to process local weather status information, to detect indicators of significant forthcoming or instantaneous changes in local weather, notifications of which are then either passed promptly to the controller 102 or which are read periodically by the controller 102.

At 404 the controller processes the received weather forecast data and the received weather status information to determine whether to increase energy input into the energy sink 106. In making this determination, the controller preferably takes account of a predicted likelihood that extra energy supplied to the energy sink will be useful. For example, where the energy sink includes a premises heating arrangement, the controller is preferably configured to predict the likelihood that the premises heating arrangement will be activated/used/required during a forecast period of lowered temperature. In predicting this likelihood, the controller preferably takes account of past household behaviour of the premises—for example whether or not the heating arrangement was used under similar meteorological conditions, at the same or corresponding time of year, and the nature of any such usage, for example the period of use, thermostat settings, et cetera. Optionally, the controller may take account of past behaviour of comparable households, the relevant data being stored in memory 202 and optionally supplied/updated from a network-based resource associated with the manufacturer/supplier/operator of the system. Preferably the controller is configured to take account of occupancy or predicted occupancy of the premises in predicting the likelihood, optionally taking account of scheduled activity of documents of the premises. The controller 102 may, for example, be part of or integrated with a "smart home" control system, and or coupled to a security monitoring system, so that occupancy and activity sensing/sensors may provide data for the controller 102 to use in predicting the likelihood. The controller may also be configured to override the setting of the heating arrangement, for example the heating arrangement may be set to turn on at some later time, and/or may be controlled by thermostat which is set at a temperature above the current ambient, so that the heating arrangement is currently off: the controller may override the timer and/or the thermostat, so that additional energy can be input into the heating arrangement.

As a result of the processing 404 and based on the weather forecast data with status information, the controller may establish a weather forecast window 406, with the start time 408 and an end time 410. At step 412, which may be performed before or after weather forecast window start time 408, the controller checks the status of the green energy source 104. At step 414, the green energy source 104 provides the controller with a status update. At step 416 the controller checks the status of the energy sink, optionally including a heating arrangement and an energy store (such as a battery, or an energy storage arrangement based on a PCM). At step 418 the energy store provides the controller with a status update. Based on the status updates, and the processing performed in step 404, the processor performs a second processing at step 420 to determine control parameters to be used in controlling the green energy source, as appropriate, and the energy sink (optionally including both a heating arrangement and an energy storage arrangement). The controller then, as appropriate, sends at 422 control instructions to the green energy source 104, and at 424 control instructions to the energy sink, based on the determined control parameters. Optionally, the green energy source and the energy sink provide feedback information at steps 426 and 428. Thereafter, as necessary the controller issues appropriate control instructions to, and receives feedback from the green energy source and the energy sink.

We will now consider why the method of the present disclosure is particularly attractive when applied to installations in which the green energy source is an air source heat pump. Consider the properties of a cold front: in advance of the cold front may be warm, with a high atmospheric pressure, and with the air possibly having a high relative humidity; as the cold front approaches, the atmospheric pressure starts to fall and cloud cover becomes more dense; then, as the cold front passes, the pressure reaches a minimum, temperature drops suddenly by as much as 10° C., or more, cloud cover becomes heavy, and heavy rain falls; after the cold front passes, the temperature may continue to fall, although the atmospheric pressure starts to increase, heavy rain becomes showers which then clear, and cloud cover tends to become less dense. Clearly, the ability to take advantage of current air temperatures, that may be 10° C. greater or more than those that can be predicted to arrive, to energise a heating installation and/or charge an energy store, is advantageous. But another very significant energy bonus can also be harvested, and that is the energy that is stored as latent heat in the warm moist air that will be displaced by the much colder and much dryer air that comes in with a cold front (and in some other meteorological phenomena). Note that air at 25° C., and 80% R.H, contains about 16 g of water per kilogram of air, whereas air at 10° C., and 80% R.H, contains about 6.3 g of water per kilogram of air.

In atmospheric air water vapor content varies from 0)-3% by mass. The enthalpy of moist and humid air includes the enthalpy of the dry air—the sensible heat, and the enthalpy of the evaporated water in the air—the latent heat. In practice, the energy stored as latent heat from the evaporation of water significantly exceeds the energy stored as sensible heat: for example, at 25° C., and 80% R.H., the enthalpy of the moist air is about 66 KJ/kg, of which latent heat from the evaporation of water contributes about 40 KJ/kg (about 60%).

If the air in the cold front is at 10° C. still with 80% R.H. (which equates to about 6.3 grams of water per kilogram of moist air) the enthalpy is about 26 KJ/kg. It can readily be appreciated that the extra 40 KJ/kg of energy that is available from the warmer air compared to the cooler air can potentially make a significant contribution to the effective efficiency of the heat pump—provided that the extra energy can be used for a useful purpose—such as pre-heating, or over-heating the premises, and/or charging or overcharging a thermal energy store.

Figure 5:
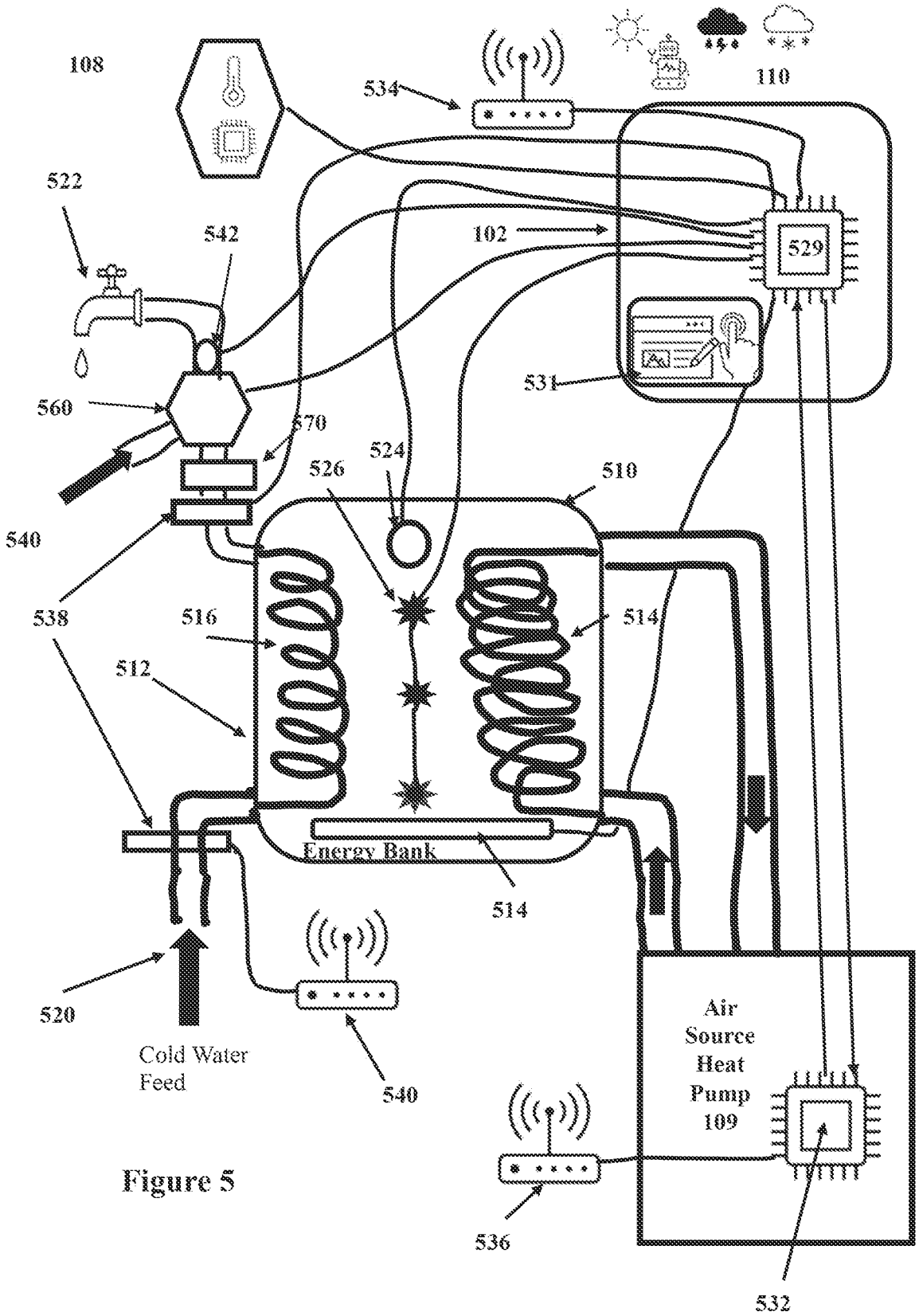
FIG. 5 is a schematic diagram showing an energy bank including a phase change material and a heat exchanger coupled to a heat pump energy source, the energy bank including one or more sensors to provide measurement data indicative of the amount of energy stored as latent heat in the phase change material.

FIG. 5 shows schematically an energy bank 510 including a heat exchanger, the energy bank comprising an enclosure 512. Within the enclosure 512 are an input-side circuit 514 of the heat exchanger for connection to an energy source-shown here as an air source heat pump 109, an output-side circuit 516 of the heat exchanger for connection to an energy sink—shown here as a hot water supply system connected to a cold-water feed 520 and including one or more outlets 522. Within the enclosure 512 is a phase-change material for the storage of energy. The energy bank 510 also includes one or more status sensors 524, to provide a measurement of indicative of a status of the PCM. For example, one or more of the status sensors 524 may be a pressure sensor to measure pressure within the enclosure. Preferably the enclosure also includes one or more temperature sensors 526 to measure temperatures within the phase change material (PCM). If, as is preferred, multiple temperature sensors are provided within the PCM, these are preferably spaced apart from the structure of the input and output circuits of the heat exchanger, and suitably spaced apart within the PCM to obtain a good "picture" of the state of the PCM.

The energy bank 510 has an associated system controller 102 which includes a processor 529. The controller may be integrated into the energy bank 510 but is more typically mounted separately. The controller 102 may also be provided with a user interface module 531, as an integrated or separate unit, or as a unit that may be detachably mounted to a body containing the controller 102. The user interface module 531 typically includes a display panel and keypad, for example in the form of a touch-sensitive display. The user interface module 531, if separate or separable from the controller 102 preferably includes a wireless communication capability to enable the processor 529 of controller 102 and the user interface module to communicate with each other. The user interface module 531 may be used to display system status information, messages, advice and warnings to the user, and to receive user input and user commands—such as start and stop instructions, temperature settings, system overrides, etc.

The status sensor(s) is/are coupled to the processor 102, as is/are the temperature sensor(s) 526 if present. The processor 102 is also coupled to a processor/controller 532 in the air source heat pump 109, either through a wired connection, or wirelessly using associated transceivers 534 and 536, or through both a wired and a wireless connection. In this way, the system controller 102 is able to send instructions, such as a start instruction and a stop instruction, to the controller 532 of the air source heat pump 109. In the same way, the processor 102 is also able to receive information from the controller 532 of the heat pump 109, such as status updates, temperature information, etc.

The hot water supply installation also includes one or more flow sensors 538 which measure flow in the hot water supply system. As shown, such a flow sensor may be provided on the cold-water feed 520 to the system, and or between the output of the output-side circuit 18 of the heat exchanger. Optionally, one or more pressure sensors may also be included in the hot water supply system, and again the pressure sensor(s) may be provided upstream of the heat exchanger/energy bank, and/or downstream of the heat exchanger/energy bank—for example alongside one or more of the one or more flow sensors 538. The or each flow sensor, the or each temperature sensor, and the or each pressure sensor is coupled to the processor 529 of the system controller 102 with either or both of a wired or wireless connection, for example using one or more wireless transmitters or transceivers 540. Depending upon the nature(s) of the various sensors 524, 526, and 538, they may also be interrogatable by the processor 529 of the system controller 102.

An electrically controlled thermostatic mixing valve 560 is coupled between the outlet of the energy bank and the one or more outlets of the hot water supply system and includes a temperature sensor 542 at its outlet. An additional instantaneous water heater, 570, for example an electrical heater (inductive or resistive) controlled by the controller 102, is preferably positioned in the water flow path between the outlet of the energy bank and the mixing valve 560. A further temperature sensor may be provided to measure the temperature of water output by the instantaneous water heater 570, and the measurements provided to the controller 102. The thermostatic mixing valve 560 is also coupled to a cold-water supply 540, and is controllable by the controller 102 to mix hot and cold water to achieve a desired supply temperature.

Optionally, as shown, the energy bank 510 may include, within the enclosure 512, an electrical heating element 514 which is controlled by the processor 529 of the system controller 102, and which may on occasion be used as an alternative to the heat pump 109 to recharge the energy bank.

The processor 102 is also coupled to a local weather sensing arrangement 108 and is configured to receive weather forecast data from an external source 110, for example via a wired or wireless data link or feed.

FIG. 5 is merely a schematic, and only shows connection of the heat pump to a hot water supply installation. It will be appreciated that in many parts of the world there is a need for space heating as well as hot water. Typically, therefore the heat pump 109 will also be used to provide space heating. An exemplary arrangement in which an air source heat pump both provides space heating and works with an energy bank for hot water heating will now be described with reference to FIG. 6.

Figure 6:
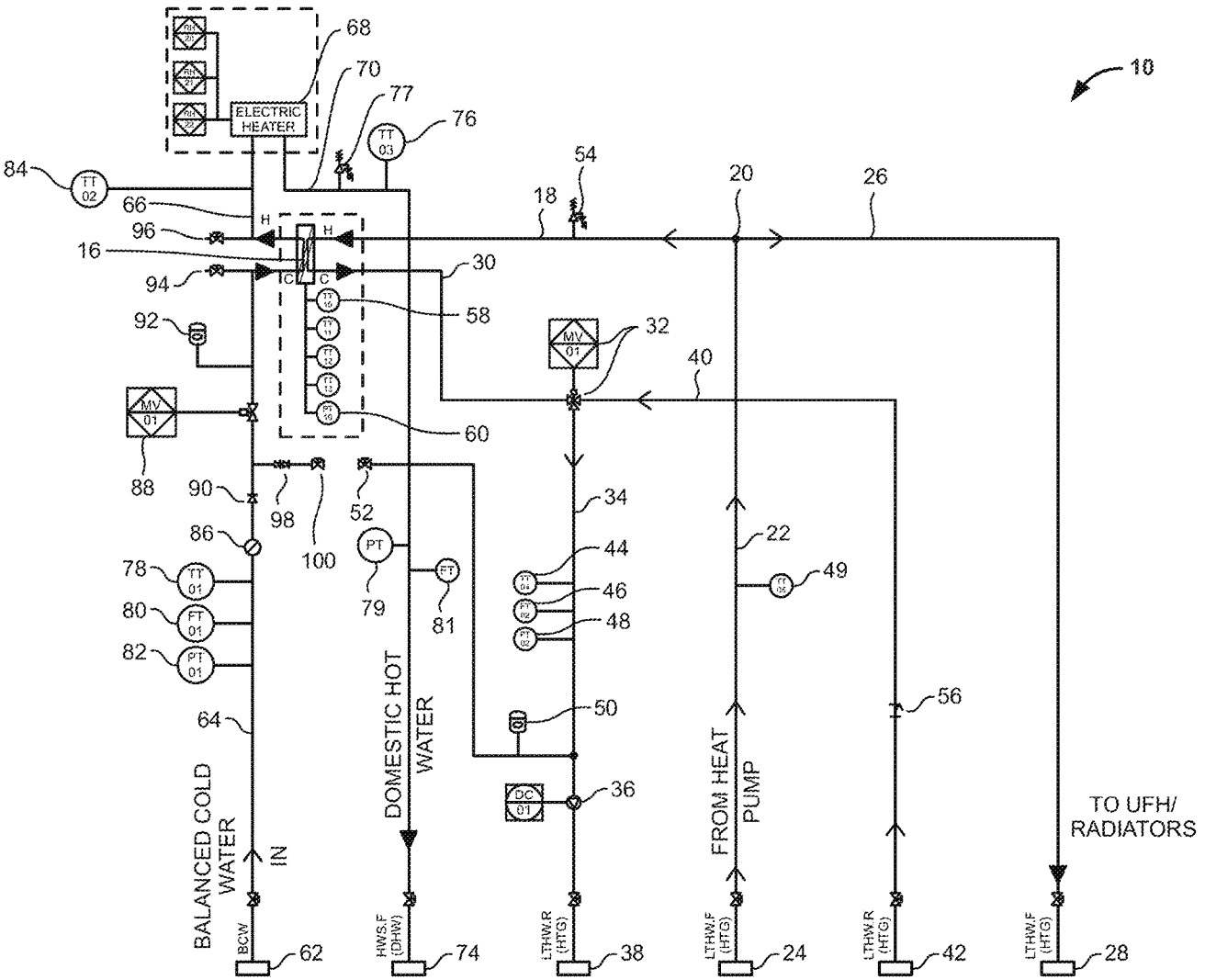
FIG. 6 is a schematic diagram showing a potential arrangement of components of an interface unit, incorporating energy bank according to an aspect of the disclosure.

FIG. 6 shows schematically a potential arrangement of components of an interface unit 10 according to an aspect of the disclosure. The interface unit interfaces between a heat pump (not shown in this Figure) and an in-building hot water system. The interface unit includes a heat exchanger 12 comprising an enclosure (not separately numbered) within which is an input-side circuit, shown in very simplified form as 14, for connection to the heat pump, and an output-side circuit, again shown in very simplified form as 16, for connection to the in-building hot water system (not shown in this Figure). The heat exchanger 12 also contains a thermal storage medium for the storage of energy, but this is not shown in the Figure. In the example that will now be described with reference to FIG. 6 the thermal storage medium is a phase-change material. It will be recognised that the interface unit corresponds to he previously described energy bank. Throughout this specification, including the claims, references to energy bank, thermal storage medium, energy storage medium and phase change material should be considered to be interchangeable unless the context clearly requires otherwise.

Typically, the phase-change material in the heat exchanger has an energy storage capacity (in terms of the amount of energy stored by virtue of the latent heat of fusion) of between 2 and 5 MJoules, although more energy storage is possible and can be useful. And of course, less energy storage is also possible, but in general one wants to maximise (subject to practical constraints based on physical dimensions, weight, cost and safety) the potential for energy storage in the phase-change material of the interface unit 10. More will be said about suitable phase-change materials and their properties, and also about dimensions etc. later in this specification.

The input side circuit 14 is connected to a pipe or conduit 18 which is in turn fed from node 20, from pipe 22 which has a coupling 24 for connection to a feed from a heat pump. Node 20 also feeds fluid from the heat pump to pipe 26 which terminates in a coupling 28 which is intended for connection to a heating network of a house or flat—for example for plumbing in to underfloor heating or a network of radiators or both. Thus, once the interface unit 10 is fully installed and operational, fluid heated by a heat pump (which is located outside the house or flat) passes through coupling 24 and along pipe 22 to node 20, from where part of the fluid flow passes along pipe 18 to the input-side circuit 14 of the heat exchanger, while the other part of the fluid flow passes along pipe 26 and out through coupling 28 to the heating infrastructure of the house or flat.

Heated fluid from the heat pump flows through the input-side circuit 14 of the heat exchanger and out of the heat exchanger 12 along pipe 30. In use, under some circumstance, heat carried by the heated fluid from the heat pump gives up some of its energy to the phase change material inside the heat exchanger and some to water in the output-side circuit 16. Under other circumstances, as will be explained later, fluid flowing through the input-side circuit 14 of the heat exchanger actually acquires heat from the phase change material.

Pipe 30 feeds fluid that leaves the input-side circuit 14 to a motorized 3-port valve 32 and then, depending upon the status of the valve out along pipe 34 to pump 36. Pump 36 serves to push the flow on to the external heat pump via coupling 36.

The motorized 3-port valve 32 also receives fluid from pipe 40 which receives, via coupling 42, fluid returning from the heating infrastructure (e.g., radiators) of the house or flat.

Between the motorized 3-port valve 32 and the pump 36 a trio of transducers are provided: a temperature transducer 44, a flow transducer 46, and a pressure transducer 48. In addition, a temperature transducer 49 is provided in the pipe 22 which brings in fluid from the output of the heat pump. These transducers, like all the others in the interface unit 10, are operatively connected to or addressable by a processor, not shown, which is typically provided as part of the interface unit—but which can be provided in a separate module.

Although not illustrated in FIG. 6, an additional electrical heating element may also be provided in the flow path between the coupler 24, which receives fluid from the output of the heat pump. This additional electrical heating element may again be an inductive or resistive heating element and is provided as a means to compensate for potential failure of the heat pump, but also for possible use in adding energy to the thermal storage unit (for example based on the current energy cost and predicted for heating and/or hot water. The additional electrical heating element is also of course controllable by the processor of the system.

Also coupled to pipe 34 is an expansion vessel 50, to which is connected a valve 52 by means of which a filling loop may be connected to top up fluid in the heating circuit. Also shown as part of the heating circuit of the interface unit are a pressure relief valve 54, intermediate the node 20 and the input-side circuit 14, and a strainer 56 (to capture particulate contaminants) intermediate coupling 42 and the 3-port valve 32.

The heat exchanger 12 is also provided with several transducers, including at least one temperature transducer 58, although more (e.g., up to 4 or more) are preferable provided, as shown, and a pressure transducer 60. In the example shown, the heat exchanger includes 4 temperature transducers uniformly distributed within the phase change material so that temperature variations can be determined (and hence knowledge obtained about the state of the phase change material throughout its bulk). Such an arrangement may be of particular benefit during the design/implementation phase as a means to optimise design of the heat exchanger—including in optimising addition heat transfer arrangements. But such an arrangement may also continue to be of benefit in deployed systems as having multiple sensors can provide useful information to the processor and machine learning algorithms employed by the processor (either of just the interface unit, and/or of a processor of a system including the interface unit.

The arrangement of the cold-water feed and the hot water circuit of the interface unit 10 will now be described. A coupling 62 is provided for connection to a cold feed from a water main. Typically, before water from the water main reaches the interface unit 10, the water will have passed through an anti-syphon non-return valve and may have had its pressure reduced. From coupling 62 cold water passes along pipe to the output-side circuit 16 of the heat exchanger 12. Given that we provide a processor that is monitoring numerous sensors in the interface unit, the same processor can optionally be given one more task to do. That is to monitor the pressure at which cold water is delivered from the mains water supply. To this end, a further pressure sensor can be introduced into the cold-water supply line upstream of coupling 62, and in particular upstream of any pressure reducing arrangement within the premises. The processor can then continually or periodically monitor the supplied water pressure, and even prompt the owner/user to seek compensation from the water supply company if the water main supplies water at a pressure below the statutory minimum.

From the output-side circuit 16 water, which may have been heated by its passage through the heat exchanger, passes along a pipe 66 to an electrical heating unit 68. The electrical heating unit 68, which is under the control of the processor mentioned previously, may comprise a resistive or inductive heating arrangement whose heat output can be modulated in accordance with instructions from the processor.

The processor is configured to control the electrical heater, based on information about the status of the phase-change material and of the heat pump.

Typically, the electrical heating unit 68 has a power rating of no more than 10 KW, although under some circumstances a more powerful heater, e.g., 12 kW, may be provided.

From the electric heater 68, what will by now hot water passes along a pipe 70 to a coupling 74 to which the hot water circuit, including controllable outlets such as taps and showers, of the house or flat will be connected.

a. A temperature transducer 76 is provided after the electric heater 68, for example at the outlet of the electric heater 68 to provide information on the water temperature at the outlet of the hot water system. A pressure relief valve 77 is also provided in the hot water supply, and while this is shown as being located between the electric heater 68 and the outlet temperature transducer 76, its precise location is unimportant—as indeed is the case for many of the components illustrated in FIG. 6.

Also somewhere in the hot water supply line is a pressure transducer 79 and or a flow transducer 81 either of which can be used by the processor to detect a call for hot water—i.e. detect the opening of a controllable outlet such as a tap or shower. The flow transducer is preferably one which is free from moving parts, for example based on sonic flow detection or magnetic flow detection. The processor can then use information from one or both of these transducers, along with its stored logic, to decide whether to signal to the heat pump to start.

It will be appreciated that the processor can call on the heat pump to start either based on demand for space heating (e.g. based on a stored program either in the processor or in an external controller, and/or based on signals from one or more thermostats—e.g. room stats, external stats, underfloor heating stats) or demand for hot water. Control of the heat pump may be in the form of simple on/off commands but may also or alternatively be in the form of modulation (using, for example, a ModBus).

As is the case with the heating circuit of the interface unit, a trio of transducers are provided along the cold-water feed pipe 64: a temperature transducer 78, a flow transducer 80, and a pressure transducer 82. Another temperature transducer 84 is also provided in pipe 66 intermediate the outlet of the output-side circuit 16 of the heat exchanger 12 and the electric heater 68. These transducers are again all operatively connected to or addressable by the processor mentioned previously.

Also shown on the cold water supply line 64 are a magnetic or electrical water conditioner 86, a motorised and modulatable valve 88 (which like all the motorised valves may be controlled by the processor mentioned previously), a non-return valve 90, and an expansion vessel 92. The modulatable valve 88 can be controlled to regulate the flow of cold water to maintain a desired temperature of hot water (measured for example by temperature transducer 76).

Valves 94 and 96 are also provided for connection to external storage tanks for the storage of cold and heated water respectively. Finally, a double check valve 98 connects cold feed pipe 64 to another valve 100 which can be used with a filling loop to connect to previously mentioned valve 52 for charging the heating circuit with more water or a mix of water and corrosion inhibiter.

It should be noted that FIG. 6 shows various of the pipes crossing, but unless these crossing are shown as nodes, like node 20, the two pipes that are shown as cross do not communicate with each other, as should by now be clear from the foregoing description of the Figure.

Although not shown in FIG. 6, the heat exchanger 12 may include one or more additional electrical heating elements configured to put heat into the thermal storage medium. While this may seem counter intuitive, it permits the use of electrical energy to pre-charge the thermal storage medium at times when it makes economic sense to do so, as will now be explained.

It has long been the practice of energy supply companies to have tariffs where the cost of a unit of electricity varies according to the time of day, to take account of times of increased or reduced demand and to help shape customer behaviour to better balance demand to supply capacity. Historically, tariff plans were rather coarse reflecting the technology both of power generation and of consumption. But increasing incorporation of renewable energy sources of electrical power-such as solar power (e.g., from photovoltaic cells, panels, and farms) and wind power, into the power generation fabric of countries has spurred the development of a more dynamic pricing of energy. This approach reflects the variability inherent in such weather-dependent power generation. Initially such dynamic pricing was largely restricted to large scale users, increasingly dynamic pricing is being offered to domestic consumers.

The degree of dynamism of the pricing varies from country to country, and also between different producers within a given country. At one extreme, "dynamic" pricing is little more than the offering of different tariffs in different time windows over the day, and such tariffs may apply for weeks, months, or seasons without variation. But some dynamic pricing regimes enable the supplier to change prices with a day's notice or less-so for example, customers may be offered today prices for half-hour slots tomorrow. Time slots of as short as 6 minutes are offered in some countries, and conceivably the lead time for notifying consumers of forthcoming tariffs can be reduced further by including "intelligence" in energy-consuming equipment.

Because it is possible to use short- and medium-term weather predictions to predict both the amount of energy likely to be produced by solar and wind installations, and the likely scale of power demand for heating and cooling, it becomes possible to predict periods of extremes of demand. Some power generation companies with significant renewable generation capacity have even been known to offer negative charging for electricity-literally paying customers to use the excess power. More often, power may be offered at a small fraction of the usual rate.

By incorporating an electric heater into an energy storage unit, such as a heat exchanger of systems according to the disclosure, it becomes possible for consumers to take advantage of periods of low-cost supply and to reduce their reliance on electrical power at times of high energy prices. This not only benefits the individual consumer, but it is also beneficial more generally as it can reduce demand at times when excess demand must be met by burning fossil fuels.

The processor of the interface unit has a wired or wireless connection (or both) to a data network, such as the Internet, to enable the processor to receive dynamic pricing information from energy suppliers. The processor also preferably has a data link connection (e.g., a ModBus) to the heat pump, both to send instructions to the heat pump and to receive information (e.g., status information and temperature information) from the heat pump. The processor has logic which enables it* to learn the behaviour of the household, and with this and the dynamic pricing information, the processor is able to determine whether and when to use cheaper electricity to pre-charge the heating system. This may be by heating the energy storage medium using an electrical element inside the heat exchanger, but alternatively this can be by driving the heat pump to a higher-than-normal temperature—for example 60 Celsius rather than between 40 and 48 Celsius. The efficiency of the heat pump reduces when it operates at higher temperature, but this can be taken into account by the processor in deciding when and how best to use cheaper electricity.

*Because the system processor is connectable to a data network, such as the Internet and/or a provider's intranet, the local system processor can benefit from external computing power. So, for example the manufacturer of the interface unit is likely to have a cloud presence (or intranet) where computing power is provided for calculations of, for example, predicted:

occupancy; activity; tariff (short/long); weather forecasts (which may be preferable to generally available weather forecasts because they can be pre-processed for easy use by the local processor, and they may also be tailored very specifically to the situation, location, exposure of the property within which the interface unit is installed); identification of false positives and/or false negatives.

To protect users from the risk of scalding by overheated water from the hot water supply system it is sensible to provide a scalding protection feature. This may take the form of providing an electrically controllable (modulatable) valve (such as valve 560 of FIG. 5) to mix cold water from the cold-water supply into hot water as it leaves the output circuit of the heat exchanger.

FIG. 6 shows schematically what might be considered the "guts" of the interface unit but does not show any container for these "guts". An important application of interface units according to the disclosure is as a means to enable a heat pump to be used as a practical contributor to the space heating and hot water requirements of a dwelling that was previously provide with a gas-fired combination boiler (or which might otherwise have such a boiler installed), it will be appreciated that it will often be convenient both to provide a container both for aesthetics and safety, just as is the case conventionally with combi boilers. Moreover, preferably any such container will be dimensioned to fit within a form factor enabling direct replacement of a combi boiler-which are typically wall mounted, often in a kitchen where they co-exist with kitchen cabinets. Based on the form of a generally rectangular cuboid (although of course, for aesthetics, ergonomics, or safety, curved surfaces may be used for any or all of the surfaces of the container) with a height, width and depth, suitable sizes may be found in the approximate ranges: height 650 mm to 800 mm; width 350 mm to 550 mm; depth 260 mm to 420 mm; for example, 800 mm high, by 500 mm wide, and 400 mm deep.

One notable distinction of interface units according to the disclosure with respect to gas combi boilers is that while the containers of the latter generally have to be made of non-combustible materials-such as steel, due to the presence of a hot combustion chamber, the internal temperatures of an interface unit will generally be considerably less than 100 Celsius, typically less than 70 Celsius, and often less than 60 Celsius. So, it becomes practical to use flammable materials such a wood, bamboo, or even paper, in fabricating a container for the interface unit.

The lack of combustion also opens up the possibility to install interface units in locations that would generally never be considered as suitable for the installation of gas combi boilers—and of course, unlike a gas combi boiler, interface units according to the disclosure, do not require a flue for exhaust gases. So, for example, it becomes possible to configure an interface unit for installation beneath a kitchen worktop, and even to make use of the notorious dead spot represented by an under-counter corner. For installation in such a location the interface unit could actually be integrated into an under-counter cupboard—preferably through a collaboration with a manufacturer of kitchen cabinets. But greatest flexibility for deployment would be retained by having an interface unit that effectively sits behind some form of cabinet, the cabinet being configured to allow access to the interface unit. The interface unit would then preferably be configured to permit the circulation pump 36 to be slid out and away from the heat exchanger 12 before the circulation pump 36 is decoupled from the flow path of the input-side circuit.

Consideration can also be given to taking advantage of other space frequently wasted in fitted kitchens, namely the space beneath under-counter cupboards. There is often more a space with a height of more than 150 mm, and a depth of around 600 mm, with widths of 300, 400, 500, 600 mm or more (although allowance needs to be made for any legs supporting the cabinets). For new installations in particular, or where a combi boiler is being replaced along with a kitchen refit, it makes sense to use these spaces at least to accommodate the heat exchanger of the interface unit—or to use more than one heat exchanger unit for a given interface unit.

Particularly for interface units designed for wall mounting, although potentially beneficial whatever the application of the interface unit, it will often be desirable to design the interface unit as a plurality of modules. With such designs it can be convenient to have the heat exchanger as one of the of modules, because the presence of the phase-change material can result in the heat exchanger alone weighing more than 25 kg. For reasons of health and safety, and in order to facilitate one-person installation, it would be desirable to ensure that an interface unit can be delivered as a set of modules none of which weighs more than about 25 kg.

Such a weight constraint can be supported by making one of the modules a chassis for mounting the interface unit to a structure. For example, where an interface unit is to be wall mounted in place of an existing gas combi boiler, it can be convenient if a chassis, by which the other modules are supported, can first be fixed to the wall. Preferably the chassis is designed to work with the positions of existing fixing points used to support the combi boiler that is being replaced. This could potentially be done by providing a "universal" chassis that has fixing holes preformed according to the spacings and positions of popular gas combi boilers. Alternatively, it could be cost effective to produce a range of chassis each having hole positions/sizes/spacings to match those of particular manufacturer's boilers. Then one just needs to specify the right chassis to replace the relevant manufacturer's boiler. There are multiple benefits to this approach: it avoids the need to drill more holes for plugs to take fixing bolts—and not only does this eliminate the time needed to mark out, drill the holes and clean up, but it avoids the need to further weaken the structure of the dwelling where installation is taking place—which can be an important consideration given the low cost construction techniques and materials frequently used in "starter homes" and other low cost housing.

Preferably the heat exchanger module and the chassis module are configured to couple together. In this way it may be possible to avoid the need for separable fastenings, again saving installation time.

Preferably an additional module includes first interconnects, e.g., 62 and 74, to couple the output side circuit 16 of the heat exchanger 12 to the in-building hot water system. Preferably the additional module also includes second interconnects. e.g. 38 and 24, to couple the input side circuit 14 of the heat exchanger 12 to the heat pump. Preferably the additional module also includes third interconnects, e.g. 42 and 28, to couple the interface unit to the heat circuit of the premises where the interface unit is to be used. It will be appreciated that by mounting heat exchanger to the chassis, which is itself directly connected to the wall, rather than first mounting the connections to the chassis, the weight of the heat exchanger is kept closer to the wall, reducing the cantilever loading effect on the wall fixings that secure the interface unit to the wall.

Phase Change Materials

One suitable class of phase change materials are paraffin waxes which have a solid-liquid phase change at temperatures of interest for domestic hot water supplies and for use in combination with heat pumps. Of particular interest are paraffin waxes that melt at temperatures in the range 40 to 60 Celsius, and within this range waxes can be found that melt at different temperatures to suit specific applications. Typical latent heat capacity is between about 180 KJ/kg and 230 KJ/kg and a specific heat capacity of perhaps 2.27 $Jg^{-1}K^{-1}$ in the liquid phase, and 2.1 $Jg^{-1}K^{-1}$ in the solid phase. It can be seen that very considerable amounts of energy can be stored taking using the latent heat of fusion. More energy can also be stored by heating the phase change liquid above its melting point. For example, when electricity costs are relatively low and it can be predicted that there will shortly be a need for hot water (at a time when electricity is likely to, or known to be going to, cost more perhaps), then it can make sense to run the heat pump at a higher-than-normal temperature to "overheat" the thermal energy store.

A suitable choice of wax may be one with a melting point at around 48 Celsius, such as n-tricosane $C_{23}$, or paraffin $C_{20}$-$C_{33}$. Applying the standard 3K temperature difference across the heat exchanger (between the liquid supplied by the heat pump and the phase change material in the heat exchanger) gives a heat pump liquid temperature of around 51 Celsius. And similarly on the output side, allowing a 3K temperature drop, we arrive at a water temperature of 45 Celsius which is satisfactory for general domestic hot water—hot enough for kitchen taps, but potentially a little high for shower/bathroom taps—but obviously cold water can always be added to a flow to reduce water temperature. Of course, if the household are trained to accept lower hot water temperatures, or if they are acceptable for some other reason, then potentially a phase change material with a lower melting point may be considered, but generally a phase transition temperature in the range 45 to 50 is likely to be a good choice. Obviously, we will want to take into account the risk of *Legionella* from storing water at such a temperature, and the previously described disinfection techniques provide a means by which this risk may be managed.

Heat pumps (for example ground source or air source heat pumps) have operating temperatures of up to 60 Celsius (although by using propane as a refrigerant, operating temperatures of up to 72 Celsius are possible), but their efficiencies tend to be much higher when run at temperatures in the range of 45 to 50 Celsius. So, our 51 Celsius, from a phase transition temperature of 48 Celsius is likely to be satisfactory.

Consideration also needs to be given to the temperature performance of the heat pump. Generally, the maximum $\Delta T$ (the difference between the input and output temperature of the fluid heated by the heat pump) is preferably kept in the range of 5 to 7 Celsius, although it can be as high as 10 Celsius.

Although paraffin waxes are a preferred material for use as the energy storage medium, they are not the only suitable materials. Salt hydrates are also suitable for latent heat energy storage systems such as the present ones. Salt hydrates in this context are mixtures of inorganic salts and water, with the phase change involving the loss of all or much of their water. At the phase transition, the hydrate crystals are divided into anhydrous (or less aqueous) salt and water. Advantages of salt hydrates are that they have much higher thermal conductivities than paraffin waxes (between 2 to 5 times higher), and a much smaller volume change with phase transition. A suitable salt hydrate for the current application is $Na_2S_2O_3 \cdot 5H_2O$, which has a melting point around 48 to 49 Celsius, and latent heat of 200/220 KJ/kg.

In terms simply of energy storage, consideration can also be given to using PCMs with phase transition temperatures that are significantly above the 40-50 Celsius range. For example, a paraffin wax, waxes being available with a wide range of melting points:

- n-henicosane $C_{24}$ which has a melting point around 40 Celsius;
- n-docosane $C_{21}$ which has a melting point around 44.5 Celsius;
- n-tetracosane $C_{23}$ which has a melting point around 52 Celsius;
- n-pentacosane $C_{25}$ which has a melting point around 54 Celsius;
- n-hexacosane $C_{26}$ which has a melting point around 56.5 Celsius; \n-heptacosane $C_{27}$ which has a melting point around 59 Celsius;
- n-octacosane $C_{28}$ which has a melting point around 64.5 Celsius;
- n-nonacosane $C_{29}$ which has a melting point around 65 Celsius; n-triacosane $C_{30}$ which has a melting point around 66 Celsius;
- n-hentriacosane $C_{31}$ which has a melting point around 67 Celsius;

n-dotriacosane $C_{32}$ which has a melting point around 69 Celsius;

n-triatriacosane $C_{33}$ which has a melting point around 71 Celsius;

paraffin $C_{22}$-$C_{45}$ which has a melting point around 58 to 60 Celsius;

paraffin $C_{21}$-$C_{50}$ which has a melting point around 66 to 68 Celsius;

RT 70 HC which has a melting point around 69 to 71 Celsius.

Alternatively, a salt hydrate such as $CH_3COONa \cdot 3H_2O$—which has a melting point around 58 Celsius, and latent heat of 226/265 KJ/kg may be used.

Thus far, the thermal energy store has largely been described as having a single mass of phase change material within a heat exchanger that has input and output circuits each in the form of one or more coils or loops. But it may also be beneficial in terms of rate of heat transfer for example, to encapsulate the phase change material in a plurality of sealed bodies—for example in metal (e.g. copper or copper alloy) cylinders (or other elongate forms)—which are surrounded by a heat transfer liquid from which the output circuit (which is preferably used to provide hot water for a (domestic) hot water system) extracts heat.

With such a configuration the heat transfer liquid may either be sealed in the heat exchanger or, more preferably, the heat transfer liquid may flow through the energy store and may be the heat transfer liquid that transfers heat from the green energy source (e.g. a heat pump) without the use of an input heat transfer coil in the energy store. In this way, the input circuit may be provided simply by one (or more generally multiple) inlets and one or more outlets, so that heat transfer liquid passes freely through the heat exchanger, without being confined by a coil or other regular conduit, the heat transfer liquid transferring heat to or from the encapsulated PCM and then on to the output circuit (and thus to water in the output circuit). In this way, the input circuit is defined by the one or more inlets and the one or more out for the heat transfer liquid, and the freeform path(s) past the encapsulated PCM and through the energy store.

Preferably the PCM is encapsulated in multiple elongate closed-ended pipes arranged in one or more spaced arrangements (such as staggered rows of pipes, each row comprising a plurality of spaced apart pipes) with the heat transfer fluid preferably arranged to flow laterally (or transverse to the length of the pipe or other encapsulating enclosure) over the pipes-either on route from the inlets to the outlets or, if an input coil is used, as directed by one or more impellers provided within the thermal energy store.

Optionally, the output circuit may be arranged to be at the top of the energy store and positioned over and above the encapsulated PCM—the containers of which may be disposed horizontally and either above an input loop or coil (so that convection supports energy transfer upwards through the energy store) or with inlets direction incoming heat transfer liquid against the encapsulated PCM and optionally towards the output circuit above. If one or more impellers is used, preferably the or each impeller is magnetically coupled to an externally mounted motor—so that the integrity of the enclosure of the energy store is not compromised.

Optionally the PCM may be encapsulated in elongate tubes, typically of circular cross section, with nominal external diameters in the range of 20 to 67 mm, for example 22 mm, 28 mm, 35 mm, 42 mm, 54 mm, or 67 mm, and typically these tubes will be formed of a copper suitable for plumbing use. Preferably, the pipes are between 22 mm and 54 mm, for example between 28 mm and 42 mm external diameter.

The heat transfer liquid is preferably water or a water-based liquid such as water mixed with one or more of a flow additive, a corrosion inhibitor, an anti-freeze, a biocide—and may for example comprise an inhibitor of the type designed for use in central heating systems—such as Sentinel X100 or Fernox F1 (both RTM)—suitably diluted in water.

Thus, throughout the description and claims of the present application the expression input circuit should be construed, unless the context clearly requires otherwise, to include an arrangement as just described and in which the path of liquid flow from the input of the input circuit to its output is not defined by a regular conduit but rather involves the liquid flowing substantially freely within the enclosure of the energy store.

The PCM may be encapsulated in a plurality of elongate cylinders of circular or generally circular cross section, the cylinders preferably being arranged spaced apart in one or more rows. Preferably the cylinders in adjacent rows are offset with respect to each other to facilitate heat transfer from and to the heat transfer liquid. Optionally an input arrangement is provided in which heat transfer liquid is introduced to the space about the encapsulating bodies by one or more input ports which may be in the form of a plurality of input nozzles, that direct the input heat transfer liquid towards and onto the encapsulating bodies fed by an input manifold. The bores of the nozzles at their outputs may be generally circular in section or may be elongate to produce a jet or stream of liquid that more effectively transfers heat to the encapsulated PCM. The manifold may be fed from a single end or from opposed ends with a view to increasing the flow rate and reducing pressure loss.

The heat transfer liquid may be pumped into the energy store 12 as the result of action of a pump of the green energy source (e.g. a heat pump or solar hot water system), or of another system pump, or the thermal energy store may include its own pump. After emerging from the energy store at one or more outlets of the input circuit the heat transfer liquid may pass directly back to the energy source (e.g. the heat pump) or may be switchable, through the use of one or more valves, to pass first to a heating installation (e.g. underfloor heating, radiators, or some other form of space heating) before returning to the green energy source.

The encapsulating bodies may be disposed horizontally with the coil of the output circuit positioned above and over the encapsulating bodies. It will be appreciated that this is merely one of many possible arrangements and orientations. The same arrangement could equally well be positioned with the encapsulating bodies arranged vertically.

Alternatively an energy store using PCM encapsulation may again use cylindrical elongate encapsulation bodies such as those previously described, but in this case with an input circuit in the form of conduit for example in the form of a coil. The encapsulation bodies may be arranged with their long axes disposed vertically, and the input 14 and output 18 coils disposed to either side of the energy store 12. But again this arrangement could also be used in an alternative orientation, such as with the input circuit at the bottom and the output circuit at the top, and the encapsulation bodies with their long axes disposed horizontally. Preferably one or more impellers are arranged within the energy store 12 to propel energy transfer liquid from around the input coil 14 towards the encapsulation bodies. The or each impeller is preferably coupled via a magnetic drive system to an externally mounted drive unit (for example an electric motor) so that the enclosure of the energy store 12 does not need to be perforated to accept a drive shaft-thereby reducing the risk of leaks where such shafts enter the enclosure.

By virtue of the fact that the PCM is encapsulated it becomes readily possible to construct an energy store that uses more than one phase change material for energy storage, and in particular permits the creation of an energy storage unit in which PCMs with different transition (e.g. melting) temperatures can be combined thereby extending the operating temperature of the energy store.

It will be appreciated that in embodiments of the type just described the energy store 12 contains one or more phase change materials to store energy as latent heat in combination with a heat transfer liquid (such as water or a water/inhibitor solution).

A plurality of resilient bodies that are configured to reduce in volume in response to an increase in pressure caused by a phase change of the phase change material and to expand again in response to a reduction in pressure caused by a reverse phase change of the phase change material are preferably provided with the phase change material within the encapsulation bodies (they may also be used in energy banks using "bulk" PCMs as described elsewhere in this specification.

The preferred embodiments of the disclosure have been described above to explain the principles of the present disclosure and its practical application to thereby enable others skilled in the art to utilize the present disclosure. However, as various modifications could be made in the constructions and methods herein described and illustrated without departing from the scope of the present disclosure, it is intended that all matter contained in the foregoing description or shown in the accompanying drawings, including all materials expressly incorporated by reference herein, shall be interpreted as illustrative rather than limiting. Thus, the breadth and scope of the present disclosure should not be limited by the above-described exemplary embodiment but should be defined only in accordance with the following claims appended hereto and their equivalents.

The invention claimed is:

1. A heating installation for premises, the installation comprising:

a controller, and coupled to the controller:

an air source heat pump configured to extract energy from surrounding air;

a premises heating arrangement; and a local weather sensing arrangement;

wherein the controller is configured to:

receive weather forecast data from a remote source, and local weather status information from the local weather sensing arrangement;

set a control algorithm based on both the weather forecast data and the local weather status information;

control a supply of energy from the air source heat pump to the premises heating arrangement based on the set control algorithm;

determine a forecast period of lowered temperature of the air from which the air source heat pump extracts energy based on the weather forecast data;

predict a likelihood that the premises heating arrangement will be used during the forecast period of lowered temperature, wherein the controller is configured to take account of occupancy or predicted occupancy of the premises and of scheduled activity of occupants of the premises in predicting the likelihood; and control the supply of energy based on the predicted likelihood that the premises heating arrangement will be used during the forecast period of lowered temperature and increase energy input into the premises heating arrangement before the forecast period of lowered temperature of the air from which the air source heat pump extracts energy.

2. The heating installation of claim 1, wherein the controller is configured to predict the likelihood based on past household behaviour of the premises, and/or on past behaviour of comparable households.

3. The heating installation of claim 1, wherein the controller is configured to override a setting of the heating arrangement.

4. The heating installation of claim 1, further comprising an energy store arranged to receive energy from the heat pump, the controller being configured to control a supply of energy from the air source heat pump to the energy store based on the set control algorithm.

5. The heating installation of claim 4, wherein the energy store comprises a mass of phase change material that is used to store energy as latent heat.

6. The heating installation of claim 5, wherein the controller is configured to control a supply of energy to the energy store to increase the amount of energy stored in the store as sensible heat.

7. The heating installation of claim 4, wherein the energy store is arranged to supply energy to a hot water system of the premises.

8. A method of controlling a premises heating installation, the premises heating installation including a controller, and coupled to the controller: an air source heat pump configured to extract energy from surrounding air, a premises heating arrangement, and a local weather sensing arrangement, the method comprising, by the controller:

receiving weather forecast data from a remote source, and local weather status information from the local weather sensing arrangement;

setting a control algorithm based on both the weather forecast data and the local weather status information;

controlling a supply of energy from the air source heat pump to the premises heating arrangement based on the setting of the control algorithm;

determining a forecast period of lowered temperature of the air from which the air source heat pump extracts energy based on the weather forecast data;

predicting a likelihood that the premises heating arrangement will be used during the forecast period of lowered temperature, taking account of occupancy or predicted occupancy of the premises and of scheduled activity of occupants of the premises in predicting the likelihood; and controlling the supply of energy based on the predicted likelihood that the premises heating arrangement will be used during the forecast period of lowered temperature, and increasing energy input into the premises heating arrangement before the forecast period of lowered temperature of the air from which the air source heat pump extracts energy.

9. The method of claim 8, further comprising predicting the likelihood based on past household behaviour of the premises, and/or on past behaviour of comparable households.

10. The method of claim 8, further comprising overriding a setting of the heating arrangement.

11. The method of claim 8, wherein the installation includes an energy store arranged to receive energy from the heat pump, the method further comprising controlling a supply of energy from the air source heat pump to the energy store based on the set control algorithm.

12. The method of claim 11, wherein the energy store comprises a mass of phase change material that is used to store energy as latent heat, the method further comprising controlling a supply of energy to the energy store to increase the amount of energy stored in the store as sensible heat.

* * * * *